United States Patent [19]

Blackwell et al.

[11] 4,199,321

[45] Apr. 22, 1980

[54] BASIC DYEING OF POLY(ARYLENE SULFIDE) RESINS

[75] Inventors: Jennings P. Blackwell; Dale O. Tieszen, both of Bartlesville, Okla.

[73] Assignee: Phillips Petroleum Company, Bartlesville, Okla.

[21] Appl. No.: 946,230

[22] Filed: Sep. 27, 1978

[51] Int. Cl.[2] ..... D06P 5/00

[52] U.S. Cl. ..... 8/168 R; 8/115.5; 528/388

[58] Field of Search ..... 8/168 R, 115.5; 528/388

[56] References Cited

U.S. PATENT DOCUMENTS

| | | | |
|---|---|---|---|
| 3,253,880 | 5/1966 | Lawson et al. | 8/115.5 |
| 3,544,519 | 12/1970 | Burrows | 260/78 |
| 3,839,301 | 10/1974 | Scoggins | 260/79 |
| 3,948,865 | 4/1976 | Brady et al. | 260/79 |
| 4,098,776 | 7/1978 | Tieszen et al. | 524/481 |

*Primary Examiner*—A. Lionel Clingman

[57] ABSTRACT

The affinity of a poly(arylene sulfide) resin composition for basic dyes is improved by contacting the composition with a sulfonating agent selected from the group consisting of sulfur trioxide, fuming sulfuric acid, and chlorosulfonic acid.

21 Claims, No Drawings

BASIC DYEING OF POLY(ARYLENE SULFIDE) RESINS

This invention relates to poly(arylene sulfide) resins. In another aspect the invention relates to a method for rendering poly(arylene sulfide) resins more receptive to basic dyes.

Poly(arylene sulfide) resins have become commercially important resins. Much of the commercial importance of the resins can be attributed to the high melting point and chemical inertness of the resins. Although such resins are generally high melting, they can be used to form a wide variety of resin products including molded objects, and more recently, fibers which can be employed to produce fabrics having outstanding chemcial resistance.

For many commercial applications it is desirable to be able to produce poly(arylene sulfide) resin products of different colors. Some of the more attractive dyes that are generally used in dyeing various polymeric materials are the basic dyes. The absence of any acid groups in the poly(arylene sulfide) resins precludes the dyeing of such resins with the basic dyes. Due to the extreme chemical inertness of poly(arylene sulfide) resin it has been difficult to discover a chemical process for adding acid groups to the resin quickly and effectively.

An object of the present invention is to provide a method for increasing the affinity of poly(arylene sulfide) resin for basic dyes.

Another object of the present invention is to provide a method for dyeing poly(arylene sulfide) resins with basic dyes.

Still another object is to provide poly(arylene sulfide) resin fabric that has been dyed with fabric dyes.

Other objects and aspects of the instant invention will become apparent from the description which follows.

In accordance with the present invention the affinity of a poly(arylene sulfide) resin composition for basic dyes is improved by contacting the composition with a sulfonating agent selected from the group consisting of sulfur trioxide, fuming sulfuric acid, and chlorosulfonic acid under suitable conditions.

In accordance with another aspect of the present invention there is provided a method for dyeing a poly(arylene sulfide) resin composition comprising contacting said composition with a sulfonating agent selected from the group consisting of sulfur trioxide, fuming sulfuric acid, and chlorosulfonic acid under conditions such that the affinity of said composition for basic dyes is improved and then dyeing the thus-treated composition.

The process of the instant invention is considered applicable to any compositions containing poly(arylene sulfide) resins. Of course, it must be noted that the presence of large amounts of other polymers that are adversely affected physically by the sulfonating agents is not desirable, since the inventive treatment would have an adverse effect upon the physical characteristics of the final product. Likewise, it is not desirable for the composition to contain large amounts of polymers that intefere with the sulfonation of the poly(arylene sulfide) resin.

Arylene sulfide resin for which the present invention is applicable includes, for example, the poly(arylene sulfide) resins prepared as described in U.S. Pat. No. 2,513,188 wherein polyhalo aromatic compounds are reacted with sulfur and metal sulfide at fusion temperature. Another example, is the poly(arylene sulfide) resins manufactured by the method described in British Pat. No. 962,941 wherein metal salts of halothiophenols are heated at a polymerizing temperature. The invention is particularly useful with polymers prepared by the reaction of polyhalo compounds with alkali metal sulfides in a polar organic compound at an elevated temperature as described in U.S. Pat. No. 3,354,129. If it is desired to employ poly(arylene sulfide) resins of lower melt flow than those obtained through the process of the just previously mentioned patent, the polymers obtained in that process can be modified according to the method disclosed in U.S. Pat. No. 3,699,087. The present invention can also be used upon p-phenylene sulfide polymers prepared as described in U.S. Pat. No. 3,919,177, wherein p-phenylene sulfide polymers are produced by reacting at least one p-dihalobenzene with a mixture in which at least one suitable source of sulfur, at least one alkali metal carboxylate, and at least one organic amide are contacted. Since the techniques of producing poly(arylene sulfide) resins disclosed in the above-mentioned patents are now known to those skilled in the art, further description of those processes will not be set forth herein. For more detail one may refer to the specific patents, which are incorporated herein by reference.

The present invention is particularly useful for poly(phenylene sulfide) resins, i.e. those resins consisting essentially of $-(R-S)-$ repeating units where R is a phenyl group. Molding grade poly(phenylene sulfide) resins can be formed into a variety of useful articles by shaping techniques which are known in the art. Shaping should be carried out generally above the melting point or softening point but below the decomposition point of the particular polymer being molded. Suitable shaping techniques include injection molding, compression molding, vacuum molding, extrusion and the like.

The instant invention is also particularly useful in regard to treating poly(arylene sulfide) resins that are in the form of films of fabrics constructed of poly(arylene sulfide) resin fibers. For the purpose of this disclosure, the terms "fiber" and "filaments" are used as equivalents to indicate lengths of polymer extrudates suitable for use in textile manufacture.

One technique for preparing "fibers" or "filaments" from poly(arylene sulfide) resins is disclosed in U.S. Pat. No. 3,898,204, the disclosure of which is incorporated herein by reference. Generally, the preferred polymers for preparing melt spun fibers are poly(phenylene sulfide) resins. In accordance with the teachings of U.S. Pat. No. 3,898,204 the poly(phenylene sulfide) resins generally used for making fibers are those having crystalline melting points in the range of about 200° C. (390° F.) to about 500° C. (930° F.). Preferred poly(phenylene sulfide) resins for making fibers have crystalline melting points in the range of about 250° C. (482° F.) to about 300° C. (572° F.). Generally such resins have melt flows usually greater than about 4,000 as determined by ASTMD-1238-70 modified for operation at 650° F. (343° C.) with a piston load of 5 kg. when prepared according to U.S. Pat. No. 3,354,129.

Such resins are then cured as taught in U.S. Pat. No. 3,898,204 to produce a resin having a melt flow in the range of about 75 to 800 as measured by the above mentioned modified ASTMD-1238-70.

Another process for producing arylene sulfide polymers suitable for conversion into fibers without a curing step is described in U.S. Pat. No. 3,919,177 which issued Nov. 11, 1975, to R. W. Campbell. According to this reference, arylene sulfide polymers are produced by reacting at least one p-dihalobenzene with a mixture in which at least one source of sulfur, at least one alkali metal carboxylate, and at least one organic amide are contacted. Since this process does not require a curing step it is presently the preferred method of producing poly(arylene sulfide) resins suitable for making fibers.

The poly(arylene sulfide) fibers can be converted into fabrics using any of the techniques conventionally used in forming woven or non-woven fabrics, including conventional weaving and knitting.

The contacting of the poly(arylene sulfide) resin compositions with the sulfonating agent can be carried out in any suitable manner. The poly(arylene sulfide) resin compositions can be rendered more receptive to basic dyes by exposure to gaseous sulfur trioxide or by exposure to sulfur trioxide in admixture with a liquid diluent that is substantially non-reactive with the sulfur trioxide and the resin. Examples of suitable such diluents include carbon tetrachloride, chlorotribromomethane, dichlorodibromomethane, trichlorobromomethane, and the like. It is to be noted that the extent of dilution of the sulfur trioxide can affect the extent of modification provided to the resin in a given time period.

The resin can also be modified in accordance with the invention by contacting with liquid chlorosulfonic acid, with gaseous chlorosulfonic acid, with liquid fuming sulfuric acid, or with fuming sulfuric acid vapors. In a preferred embodiment the fuming sulfuric acid employed contains about 20 weight percent sulfur trioxide. When the invention is carried out by contacting the resin with gaseous sulfonating agent, it is also possible to employ a gaseous diluent that is substantially unreactive with the sulfonating agent and the resin. Examples of such suitable gaseous diluents include nitrogen, carbon dioxide, argon, difluorodichloromethane, and the like.

If the sulfonating agent is diluted with a liquid diluent preferably the diluent amounts for no more than about 90 weight percent of the treating composition. If the sulfonating agent is diluted with a gaseous diluent preferably the diluent accounts for no more than about 50 weight percent of the treating composition.

The time and temperature employed for contacting the sulfonating agent and the resin can vary widely depending upon the desired characteristics in the dyed product and the effect of the chosen sulfonating agent on the other physical properties of the compositions. Generally, the contacting is carried out at a temperature in the range of about 15° C. to about 30° C. Generally the contacting is carried out for a time in the range of about 10 seconds to about 20 hours. In the preferred embodiments using more concentrated sulfonating compositions it is possible to obtain substantial increases in dyeability by contacting the resins for times in the range of about 10 seconds to about 1 hour.

After the poly(arylene sulfide) resin composition has been contacted with the described sulfonating agents it can be dyed with basic dyes in a conventional manner. It is preferable to wash the treated resin composition with water or the like to remove any excess sulfonating agent prior to the dyeing step.

Typically, the dyeing is carried out by contacting the treated resin with a solution or paste of the basic dye. The time of contacting of the treated resin and the dye is generally in the range of about ½ hour to about 2 hours. The contacting of the dye and the treated resin is generally carried out at a temperature in the range of about 80° C. to about 100° C. Generally, the dye is employed in an amount of from about 0.1 to about 5 weight percent based upon the weight of the resin to be treated.

Examples of typical basic dyes include Sevron Red 4 G, Sevron Yellow R, Maxilon Blue RLA, Maxilon Blue GLA, Maxilon Red BL, and Astrazon OG Basic Blue. The latter is a product of Verona Dyestuffs, a division of Verona-Pharma Chemical Corporation of Union, N.J.

The invention and its advantages are further illustrated by the following examples:

EXAMPLE I

The improvement in dyeability with basic dyes of samples of fabric of fibers of poly(phenylene sulfide), abbreviated hereafter as PPS, fabric immersed in various acidic media was determined in the following runs by immersing the various samples of the treated fabric in separate portions of the dye bath for a specified time, recovering the dyed samples and determining the results by visual inspection.

Two solutions were employed to form the dye bath. Solution 1 consisted of 0.25 g of an anionic surfactant, Tanapal® ME, a dyeing assistant produced by Tanatex Chemical Company, Division of Sybron Corporation, Wellford, S.C. dissolved in 1 liter of water. Solution 2 consisted of 1 g of Astrazon® OG Basic Blue, a product of Verona Dyestuffs, Division of Verona-Pharma Chemical Corporation, Union, N.J., made into a paste with a little water and 5 ml of 10% acetic acid, dissolved in 250 ml of boiling water and diluted to 1 liter with cold water.

The dyeing procedure consisted of placing a sample of PPS cloth about 30×30 mm in 25 ml of solution 1 to which was added 25 ml of solution 2. The pH of the mixture (dye bath) was adjusted to 5.5 by addition of aqueous solutions of sodium phosphate and/or acetic acid as required. The dye bath was brought to boiling and maintained at the boiling point for 1 hour. The dyed sample was removed, rinsed in running water to remove unfixed dye, dipped in acetone to displace most of the water and air dried.

The PPS cloth employed was prepared from PPS resin made in accordance with U.S. Pat. No. 3,919,177. The melt flow of the resin was measured and found to be in the range from about 180 to 300. It was melt spun through a 34-orifice spinneret at 300° C. following conventional processes. Two such yarns were plied together to form a 68 filament yarn which was drawn 3.8–4.0:1 over a hot plate at 100° C. The average denier was 350–400. Fabric was conventionally prepared from the oriented yarn in a 3/1 twill weave.

The effects of the various acidic media on the dyeability of the PPS are presented in Table 1. All treatments were conducted at 25° C.

Table 1

Dyeing Treated PPS Fabric Samples

| Run No. | Treating Solution Description | Time Hrs. | Dyeing Results |
|---|---|---|---|
| 1 | Control (no treatment) | 0 | no color |
| 2 | Conc. $H_2SO_4$ | 1 | very slight blue tint |
| 3 | Conc. $H_2SO_4$ | 17 | very light blue tint |
| 4 | 20% fuming $H_2SO_4$ | (30 seconds) | dark blue to deep purple |

Table 1-continued

| Dyeing Treated PPS Fabric Samples | | | |
|---|---|---|---|
| Run No. | Treating Solution Description | Time Hrs. | Dyeing Results |
| 5 | 20 ml conc. $H_2SO_4$ plus 5 ml 20% fuming $H_2SO_4$ | 1 | very light blue tint |
| 6 | 20 ml conc $H_2SO_4$ plus 5 ml 20% fuming $H_2SO_4$ | 17 | blue tint, good appearance |
| 7 | 2 ml chlorosulfonic acid plus 25 ml $CCl_4$ | (30 seconds) | deep purple |
| 8 | 2 ml chlorosulfonic acid plus 25 ml $CCl_4$ | 0.25 | deep purple, darker than run 7 |
| 9 | 5-6% NaOCl in $H_2O$ | 17 | very slight blue tint |

Inspection of the results in Table 1 reveals that untreated PPS fabric (control run 1) has no propensity for retaining basic dyes under the conditions employed. The results in runs 2 and 3 with concentrated $H_2SO_4$ (98%) demonstrate that the acid has only a slight effect on PPS fabric based on the dyeing results since only a light blue tint was attained even after a 17 hour treatment as shown in run 3. Invention run 4 in which 20% fuming sulfuric acid was employed for only 30 seconds clearly shows this acid is markedly effective in improving the receptivity of the PPS fabric to basic dyes based on the dark blue to deep purple color obtained. In inventive runs 7 and 8 the treating solution consists essentially of about 7.4 volume percent chlorosulfonic acid and about 92.6 volume percent carbon tetrachloride. Invention runs 7 and 8 also indicate that chlorosulfonic acid, even diluted with carbon tetrachloride to give a wt. ratio of halide to acid of about 11 to 1, is at least as effective as 20% fuming sulfuric acid, in rendering PPS fabric receptive to basic dyes. The effect of diluting 20% fuming sulfuric acid, 5 parts by volume with concentrated sulfuric acid, 20 parts by volume gives a product containing about 2% fuming sulfuric acid. Control run 5, indicates that a treating time of 1 hour with such a diluted solution is not sufficient to obtain a suitable color in the dyed fabric. However, a treating time of 17 hours is sufficient to yield a blue tint of good appearance as invention run 6 shows. Control run 9 indicates that an aqueous solution of sodium hypochlorite is not effective for imparting a receptivity to basic dyes for PPS fabric, even after a 17 hour immersion time.

EXAMPLE 2

A piece of the PPS fabric used in Example 1, measuring 30×60 mm was rolled into a roll 30 mm long and inserted into the exit end of a 50 ml capacity laboratory bubbling tube containing about 25 ml of concentrated sulfuric acid. Air was passed through the liquid at 25° C. for about 20 hours at a rate of about 30 bubbles/minute. The roll of fabric was removed, washed in water and put through the dyeing procedure described in the first example. Inspection of the recovered sample, after drying, showed it was dyed fairly deep blue for about ½ its length nearest the acid. Thus the $H_2SO_4$ vapor entrained in the air swept through the fabric roll had reacted with only a portion of the fabric. The long contact period was sufficient to make that portion more receptive to basic dyes, however.

In a second run, the procedure of the first run was repeated with a fresh piece of PPS fabric except that the bubbling tube was filled with about 25 ml of 20% fuming sulfuric acid. Air was bubbled through the liquid for 10 minutes at the same rate as before (30 bubbles/minute). The fabric, which had turned greenish-blue, was removed, washed in water and put through the dyeing procedure as before. Inspection of the recovered sample, after drying, showed that it was uniformly dyed to a fairly deep blue color, a deeper blue than in the first run. A portion of the fabric was scraped with a knife and it was found that the color appeared to extend inwardly for some distance. Thus the sulfur trioxide vapor treatment affected not only the surface of the filaments but also inwardly to some extent based on the dyeing results obtained.

The results show that sulfur trioxide vapors over a 10 minute period are much more effective than sulfuric acid vapors over a 20 hour period for treating PPS fabric, thereby rendering the treated fabric more receptive to basic dyes.

Reasonable variations and modifications, which will be apparent to those skilled in the art, can be made in this invention without departing from the spirit and scope thereof.

We claim:

1. A process for increasing the affinity of a poly(arylene sulfide) resin composition for basic dyes comprising contacting said composition with a sulfonating agent selected from the group consisting of sulfur trioxide, fuming sulfuric acid, and chlorosulfonic acid under conditions such that the affinity of said composition for basic dyes is increased.

2. A process according to claim 1 wherein the poly(arylene sulfide) resin composition consists essentially of poly(phenylene sulfide) resin.

3. A process according to claim 2 wherein the poly(phenylene sulfide) resin is in the form of fibers.

4. A process according to claim 3 wherein the fibers are associated to form a fabric.

5. A process according to claim 4 wherein the fabric is immersed in a solution of chlorosulfonic acid.

6. A process according to claim 5 wherein the solution of chlorosulfonic acid consists essentially of about 7.4 volume percent chlorosulfonic acid and about 92.6 volume percent carbon tetrachloride.

7. A process according to claim 4 wherein the fabric is immersed in fuming sulfuric acid containing about 20 weight percent sulfur trioxide based upon the weight of the fuming sulfuric acid.

8. A process according to claim 4 wherein the fabric is contacted with sulfur trioxide gas.

9. A molded poly(arylene sulfide) resin product receptive to basic dyes produced by contacting the molded product with a sulfonating agent in accordance with the process of claim 1.

10. A poly(arylene sulfide) resin fabric having affinity for basic dyes produced by treating a poly(arylene sulfide) resin fabric with a sulfonating agent in accordance with the process of claim 1.

11. A process of dyeing a composition comprising a poly(arylene sulfide) resin, said process comprising contacting said composition with a sulfonating agent selected from the group consisting of sulfur trioxide, fuming sulfuric acid, and chlorosulfonic acid under conditions such that the affinity of said article for basic dyes is increased and then subjecting the thus treated article with a basic dye.

12. A process according to claim 9 wherein the poly(arylene sulfide) resin composition consists essentially of poly(phenylene sulfide) resin.

13. A process according to claim 10 wherein the poly(phenylene sulfide) resin is in the form of fibers.

14. A process according to claim 11 wherein the fibers are associated to form a fabric.

15. A process according to claim 12 wherein the fabric is immersed in a solution of chlorosulfonic acid.

16. A process according to claim 13 wherein the solution of chlorosulfonic acid consists essentially of about 7.4 volume percent chlorosulfonic acid and about 92.6 volume percent carbon tetrachloride.

17. A process according to claim 12 wherein the fabric is immersed in fuming sulfuric acid containing about 20 weight percent sulfur trioxide based upon the weight of the fuming sulfuric acid.

18. A process according to claim 12 wherein the fabric is contacted with sulfur trioxide gas.

19. A dyed molded poly(arylene sulfide) resin product produced in accordance with the process of claim 11.

20. A dyed poly(arylene sulfide) resin fabric produced in accordance with the process of claim 11.

21. A fabric in accordance with claim 20 wherein the poly(arylene sulfide) resin is poly(phenylene sulfide) resin.

* * * * *